US012453891B2

(12) United States Patent
Oguma

(10) Patent No.: US 12,453,891 B2
(45) Date of Patent: Oct. 28, 2025

(54) PULL-UP/CHIN-UP INSTRUMENT

(71) Applicant: TEDDY WORKS Co., Ltd, Tokyo (JP)

(72) Inventor: Shota Oguma, Tokyo (JP)

(73) Assignee: TEDDY WORKS Co., Ltd., Tokyo (JP)

( * ) Notice: Subject to any disclaimer, the term of this patent is extended or adjusted under 35 U.S.C. 154(b) by 57 days.

(21) Appl. No.: 18/038,004

(22) PCT Filed: Aug. 27, 2021

(86) PCT No.: PCT/JP2021/031533
§ 371 (c)(1),
(2) Date: May 19, 2023

(87) PCT Pub. No.: WO2022/158022
PCT Pub. Date: Jul. 28, 2022

(65) Prior Publication Data

US 2023/0414995 A1 Dec. 28, 2023

(30) Foreign Application Priority Data

Jan. 22, 2021 (JP) ..... 2021-008868

(51) Int. Cl.
*A63B 23/12* (2006.01)
*A63B 21/00* (2006.01)
(Continued)

(52) U.S. Cl.
CPC .... *A63B 23/1218* (2013.01); *A63B 21/00047* (2013.01); *A63B 21/068* (2013.01); *A63B 21/1681* (2013.01); *A63B 2225/093* (2013.01)

(58) Field of Classification Search
CPC ..... A63B 23/1218; A63B 21/00047; A63B 21/068; A63B 21/1681; A63B 2225/093;
(Continued)

(56) References Cited

U.S. PATENT DOCUMENTS 5,470,294 A * 11/1995 Ingram ..... A47D 13/04 482/89
5,997,448 A * 12/1999 Duba ..... A63B 21/1681 482/121
(Continued)

FOREIGN PATENT DOCUMENTS

CN 209984844 U 1/2020
EP 3 488 902 A1 5/2019
(Continued)

OTHER PUBLICATIONS

International Search Report from International Patent Application No. PCT/JP2021/031533, Nov. 9, 2021.
(Continued)

*Primary Examiner* — Andrew M Kobylarz
(74) *Attorney, Agent, or Firm* — Potomac Law Group, PLLC

(57) ABSTRACT

A pull-up/chin-up instrument (1) comprises, as its main components, one support column (2) which is maintained in an erected state by being propped up between a ceiling surface (Sc) and a floor surface (Sf) of a house, and a pull-up/chin-up handle (3) fixed to an upper part of the one support column (2). According to this configuration, there can be provided a pull-up/chin-up instrument, which realizes a reduced installation space and a low product price. The pull-up/chin-up handle (3) is supported by the one support column (2) only. The support column (2) is preferably inclined with a predetermined inclination angle (θ) with respect to the direction of gravity. The main part of the support column (2) may include an upper pipe (11) on the side of the ceiling surface (Sc), a lower pipe (12) on the side of the floor surface (Sf) and a middle pipe (13) that is slidably fitted into the upper pipe (11) and lower pipe (12).

3 Claims, 9 Drawing Sheets

(51) Int. Cl.
*A63B 21/068* (2006.01)
*A63B 21/16* (2006.01)

(58) Field of Classification Search
CPC ... A63B 2210/50; A63B 1/00; A63B 21/4035; A63B 2225/09; A63B 23/02; A63B 23/12; A63B 2209/00
See application file for complete search history.

(56) References Cited

U.S. PATENT DOCUMENTS

| | | | | |
|---|---|---|---|---|
| 2009/0283360 | A1* | 11/2009 | Eckerdt | A61G 7/053 182/100 |
| 2010/0184573 | A1* | 7/2010 | Tucker | A63B 21/1681 482/148 |
| 2010/0311024 | A1* | 12/2010 | Schenck | A63B 21/1681 434/258 |
| 2016/0184164 | A1* | 6/2016 | Browning | A63B 21/015 482/115 |
| 2017/0035483 | A1 | 2/2017 | Crainich et al. | |
| 2017/0056718 | A1* | 3/2017 | Davis | A63B 21/169 |

FOREIGN PATENT DOCUMENTS

| | | | |
|---|---|---|---|
| JP | S55-43033 | U1 | 3/1980 |
| JP | S57-93323 | U1 | 6/1982 |
| JP | 2001-137382 | A | 5/2001 |
| JP | 3228222 | U | 10/2020 |

OTHER PUBLICATIONS

Makuake. [online], Nov. 21, 2020, Internet: <URL: https://web.archive.org/web/20201120230804/https://www.makuake.com/project/kensui/>, [retrieved on Oct. 26, 2021], non-official translation ([Factories Starting in Ota Ward!] Space-Saving Pull-Up Machine—One Product of Craftsmanship Combining Japanese Technology and Ingenuity.).

KENSUI. YouTube. [online] [video], Oct. 5, 2020, Internet: <URL: https://www.youtube.com/watch?v=U4pSGd09AsM>, [retrieved on Oct. 26, 2021], non-official translation ([How to Install] Japanese-Made Pull-Up Machine KENSUI.

Notification of Reasons for Refusal from Japanese Patent Application No. 2021-008868, Feb. 8, 2022.

Written Submission of Certificate to qualify for Exception to Lack of Novelty of Invention, filed Feb. 12, 2021, in Japanese Patent Application No. 2021-008868.

* cited by examiner

Fig. 9
Fig. 9A
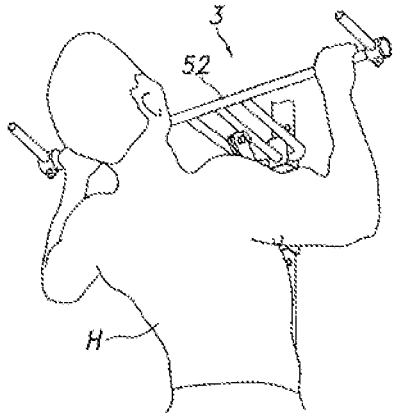
Fig. 9B
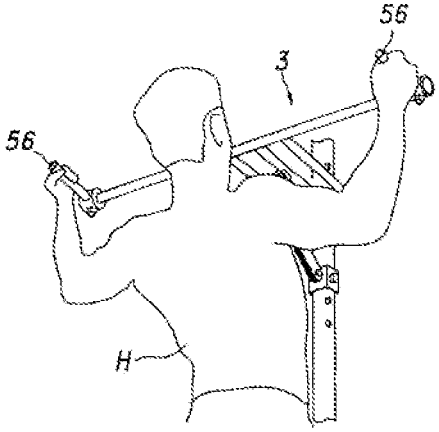
Fig. 9C
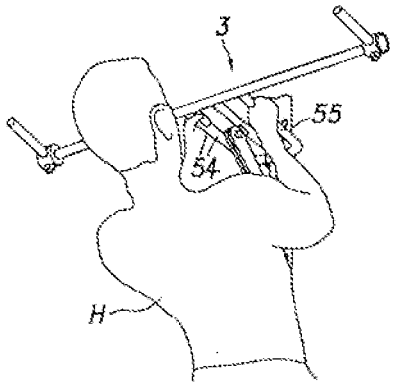

PULL-UP/CHIN-UP INSTRUMENT

TECHNICAL FIELD

The present invention relates to a pull-up/chin-up instrument which is used for pull-up/chin-up training, and relates to a technique for reducing an area of a floor on which a pull-up/chin-up machine is rested or a technique for realizing reduced product cost.

BACKGROUND ART

A pull-up/chin-up instrument that is also called as a pull-up machine, chinning stand or the like, is known as an instrument for disciplining muscles of an upper part of a human body, such as, latissimus dorsi, greater pectoralis muscle, cowl muscle, biceps brachii and the like. The pull-up/chin-up instrument is composed of a frame rested on a floor, a pull-up handle attached to an upper part of the frame, and the like, and the height of the pull-up/chin-up handle is adjustable according to height of a user. The frame of the pull-up/chin-up instrument is set relatively large in weight, and leg portions to be in contact with the floor surface is large enough in size, so as not to be unstable or topple down during being used. (Refer to Patent Document No. 1 and No. 2).

PRIOR ART REFERENCE

Patent Document

Patent Document 1: Japan Utility Model Registration No. 3228222.

Patent Document 2: Japan Application Laid-open No. 2001-137382

SUMMARY OF THE INVENTION

The Object to be Solved by the Invention

The above-mentioned conventional pull-up/chin-up instrument has a large frame in weight and requires a large space for installation, so it is not easy to install in a residential house in view of strength as well as space of the floor. Further, in the pull-up/chin-up instrument, the frame is a welded or fastened structure made of many steel pipes and steel plates, so a number of steps are required for manufacture, and accordingly price of product is high inevitably.

In view of the above problems being taken into consideration, the present invention has for its object to provide a pull-up/chin-up instrument realizing reduced installation space and low product price.

Means for Solving the Problem

The pull-up/chin-up instrument of the present invention comprises one support column that is held in an erected state by being propped between a ceiling surface and a floor surface, and a pull-up/chin-up handle for a pull-up/chin-up exercise of a user, being characterized in that:

said pull-up/chin-up handle is supported by said support column only.

Advantageous Effect of the Invention

According to the present invention, there can be provided a pull-up/chin-up instrument, which realizes a reduced installation space and a low product price.

BRIEF DESCRIPTION OF THE DRAWINGS

FIG. 9A to FIG. 9C are perspective views showing use patterns of the pull-up/chin-up handle relating to the embodiment of the present application.

EMBODIMENT FOR CARRYING OUT THE INVENTION

The following is a detailed description of the embodiment of the invention, referring to FIGS. 1 through 9C.

Configuration of the Embodiment

Figure 1:
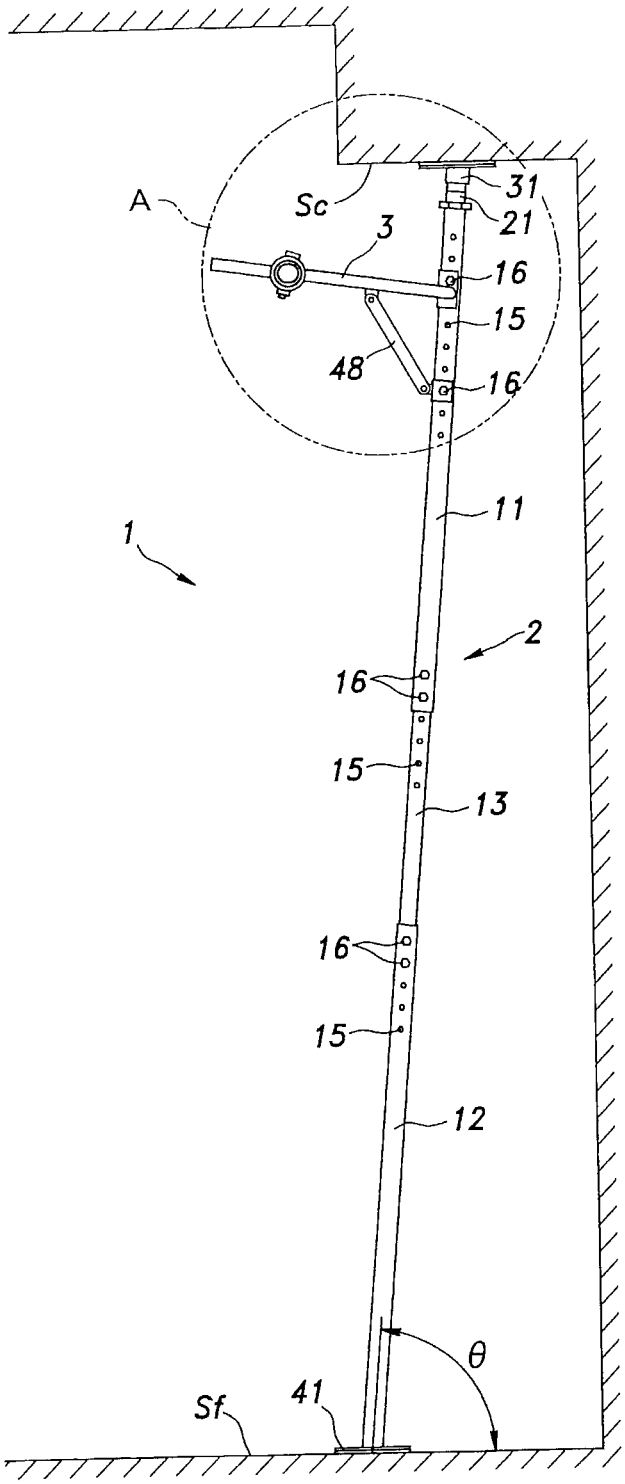
FIG. 1 shows a side view of the pull-up/chin-up instrument relating to the embodiment of the present application.

As shown in FIG. 1, the pull-up/chin-up instrument 1 of the embodiment comprises, as its main components, one support column 2, which is maintained in an erected state by being propped up between a ceiling surface of a house or a lower surface Sc of a ceiling beam and the floor surface Sf, as in the illustrated example, and a pull-up/chin-up handle 3 fixed to the upper part of the one support column 2. The pull-up/chin-up handle 3 is supported by the one support column 2 only. The support column 2 is inclined with a predetermined inclination angle θ with respect to the floor surface Sf. In other words, the support column 2 is inclined with a predetermined inclination angle θ with respect to the direction of gravity. The inclination angle θ can be 80° to 90°, in other words, 20° to 10° relative to the direction of gravity, and most preferably 85°, in other words, 15° relative to the direction of gravity. In the present application, by the term "ceiling surface" is meant the surface of a part in a building that has a space on the lower side, and by term "floor surface" is meant the surface of a part in a building that has a space on the upper side.

The main part of the support column 2 includes an upper pipe 11 on the side of the ceiling surface Sc, a lower pipe 12 on the side of the floor surface Sf and a middle pipe 13 that is slidably fitted into the upper pipe 11 and lower pipe 12. The upper pipe 11, lower pipe 12 and middle pipe 13 are all made of drawn steel pipes. A plurality of bolt holes 15 are drilled at predetermined intervals in the longitudinal direction, such as 50 mm, respectively, at the fitting portions of the upper pipe 11 and the middle pipe 13 and at the fitting portions of the lower pipe 12 and the middle pipe 13. The length of the support column 2 is adjusted by inserting the middle pipe 13 into the upper pipe 11 or lower pipe 12 by a desired amount, aligning the bolt holes 15 with each other, inserting bolts 16 into the bolt holes 15 and fastening them with unshown nuts.

Figure 2:
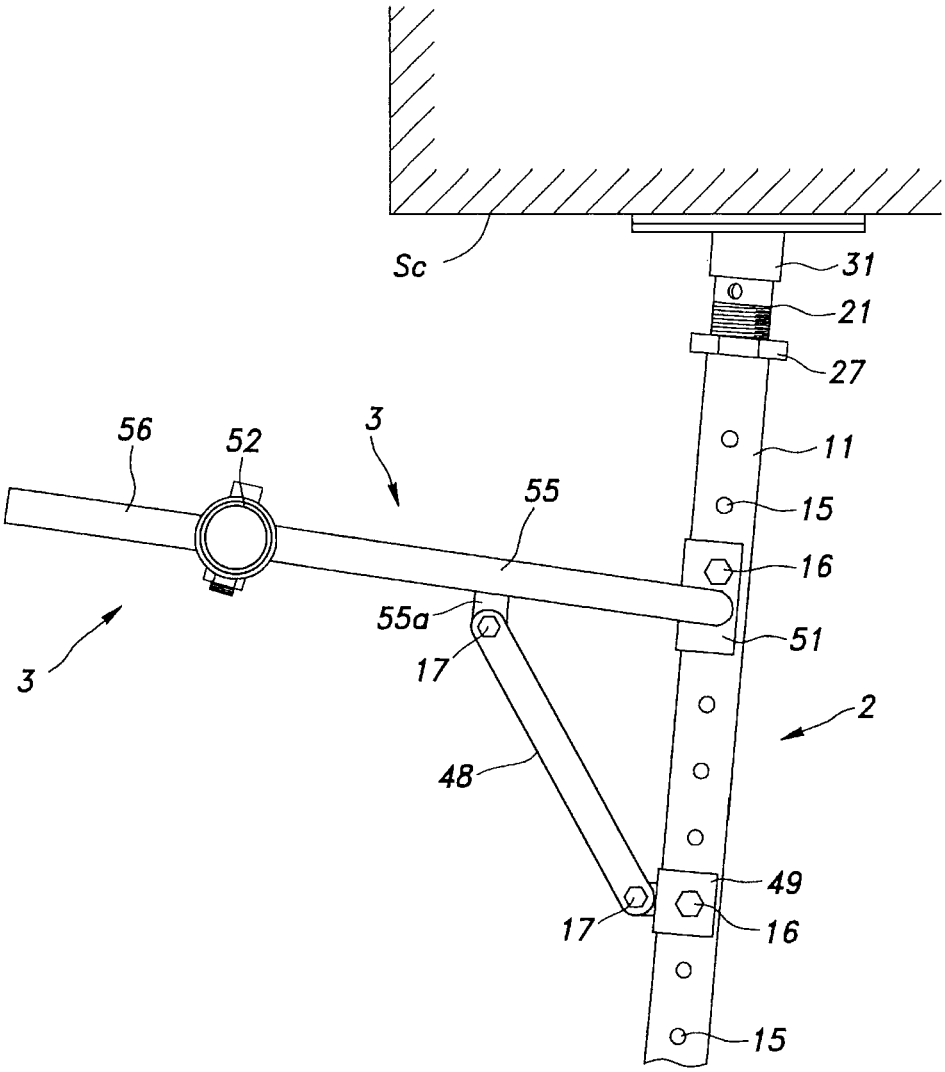
FIG. 2 is an enlarged view of a part A in FIG. 1.
Figure 3:
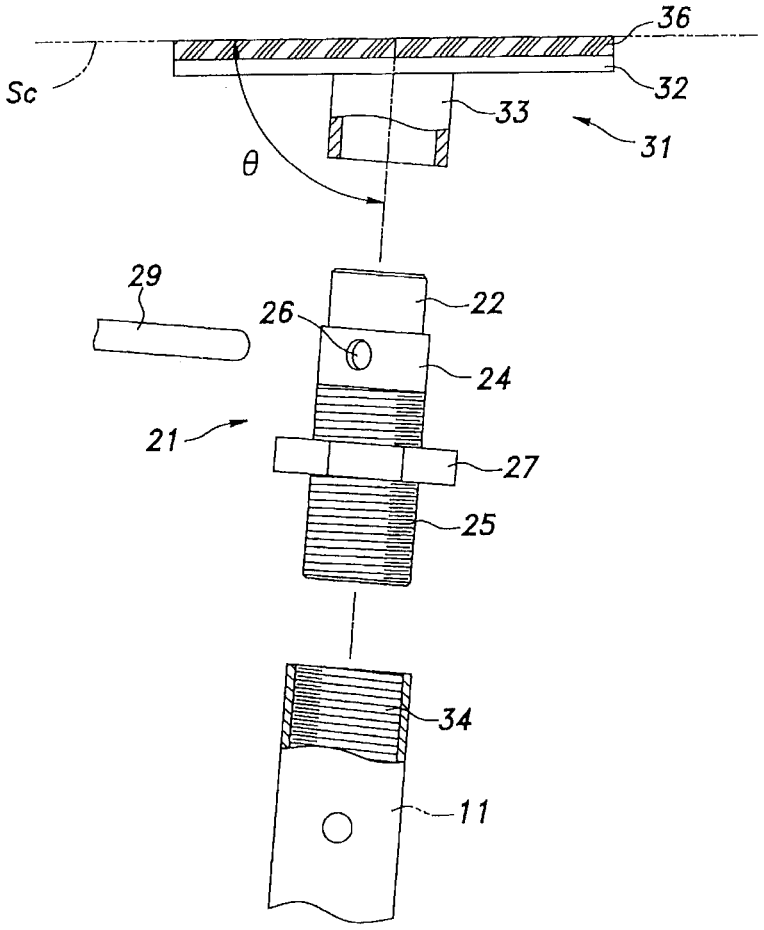
FIG. 3 is an exploded view of a length adjustment part relating to the embodiment of the present application.

As shown in FIG. 2, an upper plate 31 is connected to the upper end of the upper pipe 11 through an adjust pipe 21. As shown in FIG. 3, the upper plate 31 includes a square plate body 32 made of steel plate and a connecting pipe portion 33 which is, over the entire periphery thereof, welded to the lower surface of the plate body 32. The connecting pipe portion 33 is inclined with an inclination angle θ with respect to the plate body 32 in order to realize the forward inclination of the support column 2. An upper seat 36 made of foamed resin such as PE sponge or PU sponge or rubber is adhered to the upper surface of the upper plate 31 as an upper elastic member. In an assembled state of the pull-up/chin-up instrument, the upper seat 36 is in contact with the ceiling surface Sc with a predetermined pressure. This prevents the upper plate 36 from damaging the ceiling surface Sc and prevents the upper plate 36 from slipping on the ceiling surface Sc.

The adjusting pipe 21 includes a small diameter portion 22 that is fitted into the connecting pipe portion 33 of the upper plate 31 and a large diameter portion 24 that continues to a lower portion of the small diameter portion 22. The large-diameter portion 24 is formed on a lower portion thereof with a male thread 25 that is screwed into a female thread 34 formed in the lower pipe 12, and is formed with a through hole 26 into which a tightening bar 29 is inserted. An octagonal lock nut 27 is screwed onto the male thread 25 of the adjusting pipe 21.

Figure 4:
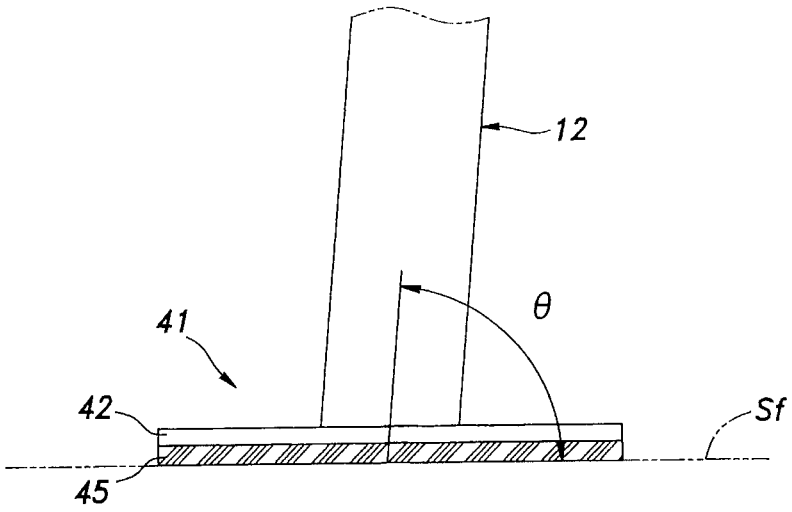
FIG. 4 is a side view of a lower plate relating to the embodiment of the present application.

As shown in FIG. 4, the lower end of the lower pipe 12 over the entire periphery thereof is welded and fixed to the upper surface of the lower plate 41. The lower pipe 12 is inclined with an inclination angle θ with respect to the lower plate 41 in the same way as the connecting pipe portion 33 of the upper plate 31. A lower seat 45, which is the same as the upper seat 36, is adhered to the lower surface of the lower plate 41 as a lower elastic member. This lower seat 45 in the assembled state of the pull-up/chin-up instrument 1 is in contact with the floor surface Sf with a predetermined pressure. Thus, the ceiling surface Sf is prevented from being damaged by the lower plate 41 and the lower plate 41 is prevented from slipping on the floor surface Sf.

As shown in FIG. 2, the pull-up/chin-up handle 3 has its base end fixed to an upper portion of the upper pipe 11 and is supported by a support plate 48 fixed to the upper pipe 11. The upper pipe 11 is formed with a plurality of bolt holes 15 at predetermined intervals of, for example, 50 mm, in the longitudinal direction. The pull-up/chin-up handle 3 and the support plate 48 are fastened with the bolts 16 inserted through the bolt holes 15 and nuts (not shown). In the case of the present embodiment, the position of the pull-up/chin-up handle 3 in the vertical direction can be adjusted in five stages by changing the bolt hole 15 to be tightened.

Figure 5:
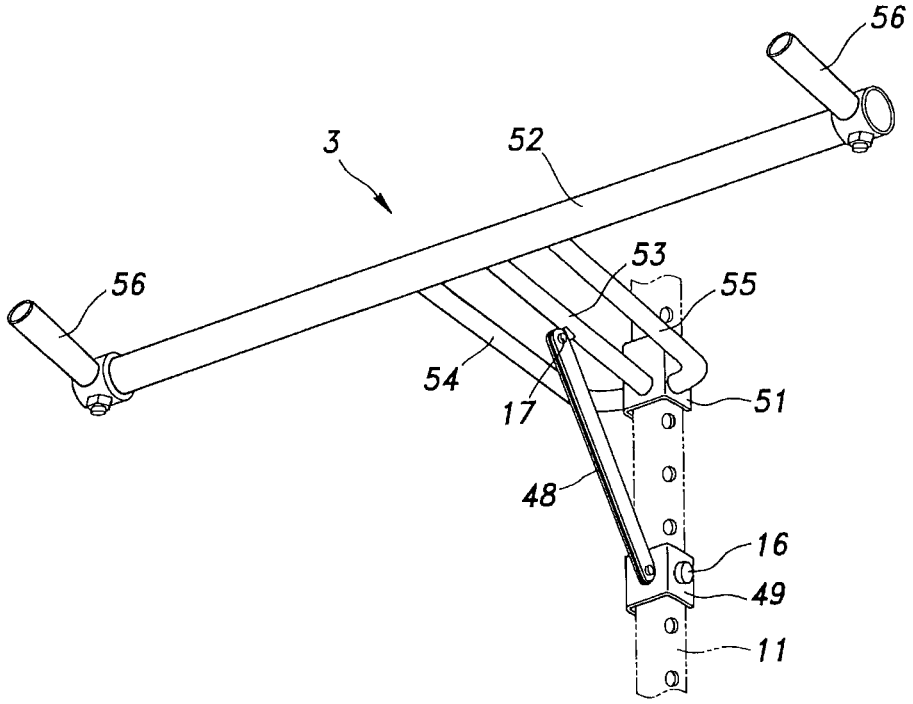
FIG. 5 is a perspective view of the pull-up/chin-up handle relating to the embodiment of the present application.

As shown in FIG. 5, the pull-up/chin-up handle 3 is composed of a base bracket 51 having a U-shaped cross section that sandwiches the support column 2, a main bar 52 arranged behind the base bracket 51, a connecting pipe 53 connecting the base bracket 51 and the main bar 52, a pair of left and right narrow bars 54 and 55 arranged on the sides of the connecting pipe 53, parallel handles 56 attached to the left and right ends of the main bar 52, and the like. The base bracket 51 is made of steel plate. The main bar 52, connecting pipe 53, narrow bars 54 and 55 and the like are made of iron.

Figure 6:
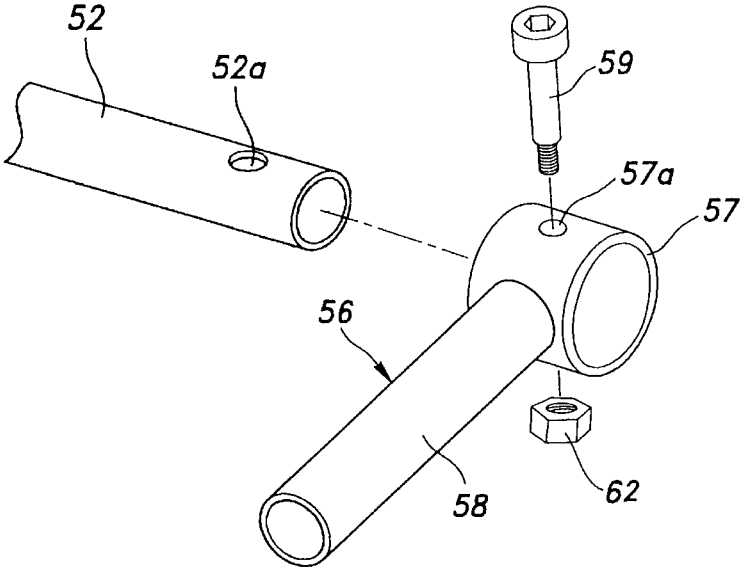
FIG. 6 is a perspective view of a parallel handle relating to the embodiment of the present application.

The main bar 52 is in the shape of a straight tube extending in the left and right direction, and the main bar 52 at its left and right ends, as shown in FIG. 6, is formed through with handle support holes **52*a*** in the vertical direction.

The connecting pipe 53 has its ends welded to the base bracket 51 and to the main bar 52, and a lower surface of a rear portion of the connecting pipe 53 is welded to a stay **55*a*. The narrow bars 54 and 55 are bent inward at their front ends and welded to the base bracket 51, and the rear ends of the narrow bars 54 and 55 are abutted against the main bar 52 and welded thereto. On the other hand, the support plate 48 is composed of two plate members and is connected, by means of bolts 17 and nuts (not shown), at its front end to the upper pipe 11 through a support pipe bracket 49 having a semicircular cross-section, and at its rear end to the stay 55*a* of the connecting pipe 53**.

As shown in FIG. 6, the parallel handles 56 each includes a cylindrical handle base 57 fitted on the end of the main bar 52, and a steel pipe handle body 58 press-fitted into a rear portion of the handle base 57. A bolt hole **57*a* is formed through in the handle base 57 at a position corresponding to the handle support hole 52*a* of the main bar 52, and the handle base 57 is fastened to the main bar 52 with a bolt 59 and a nut 62**.

Operation of Embodiment (Installation of the Pull-Up/Chin-Up Instrument)

Figure 7:
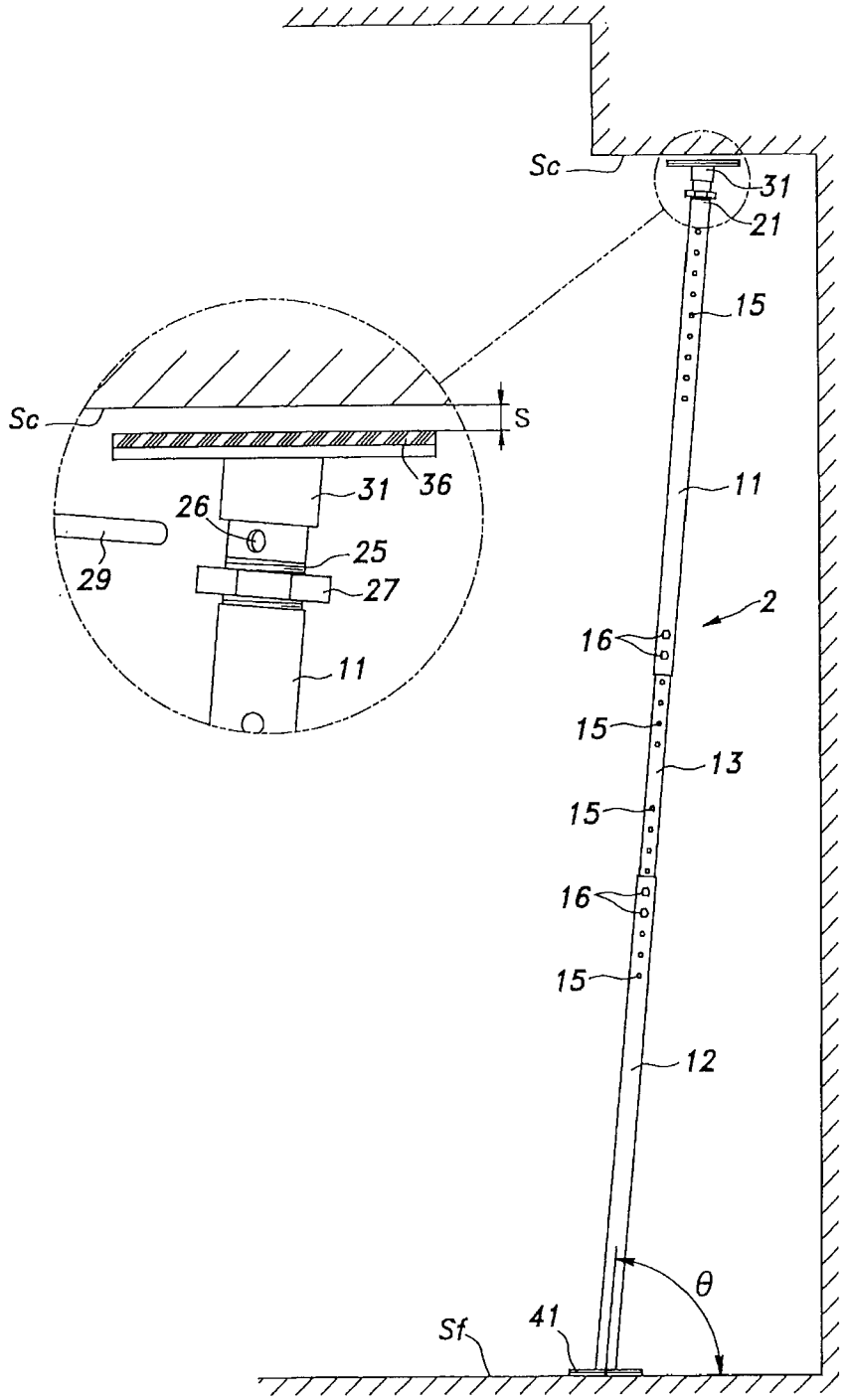
FIG. 7 is a side view of an assembly process of the support column relating to the embodiment of the present application.

To install the pull-up/chin-up instrument 1, the operator assembles the support column 2 by combining the required parts, adjusts the length of the support column 2 so that a gap S may be formed between the ceiling surface Sc and the upper seat 36, and sets the support column 2 between the ceiling surface Sc and the floor surface Sf, as shown in FIG. 7. Next, the operator supports the support column 2 with one hand while rotating the adjusting pipe 21 with the other hand to the left when viewed from below. Then, since the male thread 25 of the adjusting pipe 21 and the female thread 34 of the upper pipe 11 are in screw engagement with each other, the adjusting pipe 21 and the upper plate 31 are gradually raised by the screw action so that the upper seat 36 is brought into contact with the ceiling surface Sc.

Next, the operator inserts the tightening bar 29 into the through hole 26 and rotates the adjusting pipe 21 with an appropriate torque. Thus, the upper seat 36 is brought into contact with the ceiling surface Sc with a predetermined pressure, and the lower seat 45 is brought into contact with the floor surface Sf with a predetermined pressure, thereby the support column 2 being fixed. After confirming that the support column 2 is firmly fixed, the operator tightens the locknut 27 to prevent the adjusting pipe 21 from loosening.

Once the support column 2 has been fixed, the operator assembles the pull-up/chin-up handle 3 on the upper pipe 11 in a vertical position so as to meet with a user's physique, as shown in FIG. 2, connects one end of the support plate 48 to the stay **55*a* of the connecting pipe 53, and connects the support pipe bracket 49 of the support plate 48 to the upper pipe 11. The operator then tightens each of the bolts 16, 17 with the prescribed tightening torque to complete the installation of the pull-up/chin-up instrument 1**.

(Use of Pull-Up/Chin-Up Instrument)

Figure 8:
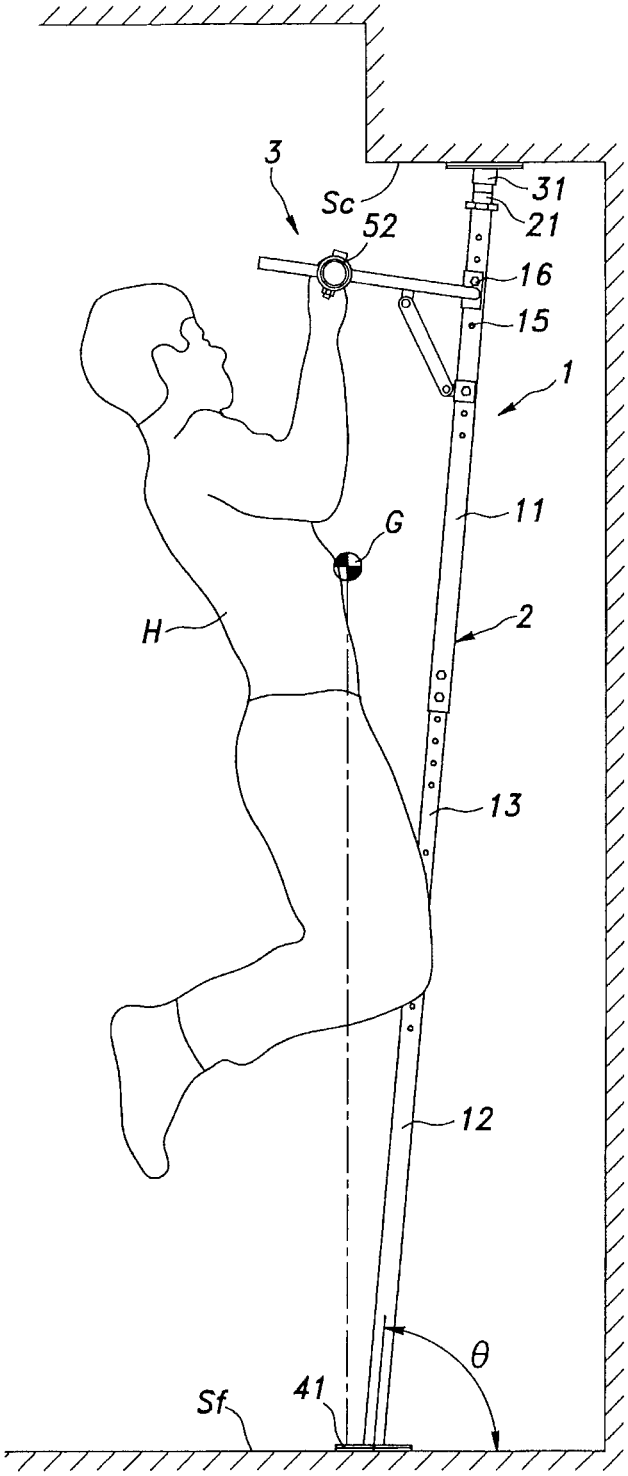
FIG. 8 is a side view of the pull-up/chin-up instrument in use relating to the embodiment of the present application.

As shown in FIG. 8, when the user H hangs from the pull-up/chin-up handle 3, a leftward rotation torque acts on the pull-up/chin-up handle 3 with the base bracket 51 as a fulcrum, but the pull-up/chin-up handle 3 is not rotated. Further, since the center of gravity G of the user H and the pull-up/chin-up handle 3 is positioned directly above or in the vicinity of the lower plate 41, no or almost no rotational moment which would be otherwise caused due to the weight of the user H and pull-up/chin-up handle 3, acts on the support column 2. Accordingly, the pull-up/chin-up instrument 1 is very difficult to fall over in spite of its relatively low weight.

In the case of wide grip chinning, as shown in FIG. 9A, the user H holds the main bar 52 with both hands and performs a pull-up/chin-up exercise, which trains the lateral latissimus dorsi, trapezius, and biceps brachii muscles. In the case of wide parallel chinning, as shown in FIG. 9B, the user H grabs the parallel handles 56 and performs a pull-up/chin-up exercise, thereby training the deltoid, latissimus dorsi, and auricularis major muscle. In the case of narrow grip chinning, as shown in FIG. 9C, the user H grabs the narrow bars 54 and 55 and performs a pull-up/chin-up exercise, thereby training the deltoid, latissimus dorsi and auricularis major muscle. Meanwhile, the parallel handles 56 may be removed from the main bar 52 when wide parallel chinning is not performed on a daily auricularis major muscle basis.

Effects of Embodiment

By adopting the above-described configuration, the pull-up/chin-up instrument 1 of the present embodiment can be installed in a much smaller installation space than conventional devices, and can be easily installed in ordinary homes. In addition, since the number and the weight of components are greatly reduced, it is possible to reduce the product price and reduce the burden on the floor surface Sf. In addition, since the support column 2 is divided into 3 pieces, the upper pipe 11, the lower pipe 12 and the middle pipe 13, the handling during assembly is facilitated, and the cost required for packing and transportation is reduced.

Although the specific embodiment has been described above, aspects of the present invention are not limited thereto. For example, in the above embodiment, the lower pipe 12 and the lower plate 41 are integrated by welding, but these may be separate members. Also, in the above embodiment, the support column 2 was divided into three pieces, but it may be divided into two pieces, or it may be divided into four or more pieces. Further, in the above embodiment, the support column 2 is inclined with a forward inclination angle of 5° with respect to the vertical line, but a forward inclination angle other than 5° may be adopted, or the column may be erected against the floor surface Sf. In the above embodiment, the main bar 52 and parallel handles 56 are separate parts, but the parallel handles may be parts of the main bar 52 bent backwards at both ends. Other specific configurations and shapes of the support column 2 and pull-up/chin-up handle 3 can also be changed as required, as long as the main purpose of the invention is not departed from.

INDUSTRIAL APPLICABILITY

The present invention can be effectively used in a pull-up/chin-up instrument for pull-up/chin-up training.

DESCRIPTION OF THE REFERENCES

1 Pull-up/chin-up instrument
2 Support column
3 pull-up/chin-up handle
11 Upper pipe
12 Lower pipe
13 Middle pipe
21 Adjusting pipe
31 Upper plate
36 Upper seat
41 Lower plate
45 Lower seat
48 Support plate
52 Main bar
52*a* Handle support hole
54, 55 Narrow bar
55*a* Stay
56 Parallel handle
62 Nut
Sc Ceiling surface
Sf Floor surface
θ Inclination angle

What is claimed is:

1. A pull-up/chin-up instrument comprising:

one support column which is maintained in an erect state by being propped between a ceiling surface and a floor surface, and a pull-up/chin-up handle overhanging from and fixed to an upper part of the support column and configured for a user to perform pull-up/chin-up exercises, a lower plate facing the floor surface provided at a side of a lower end of the support column, and an upper plate facing the ceiling surface provided at a side of an upper end of the support column, wherein said pull-up/chin-up handle is supported by the support column only, and the lower plate and the upper plate are disposed approximately parallel to each other such that a central axial line of the support columnn and the lower plate form an obtuse angle on an overhanging side of the pull-up/chin-up handle, and the central axial line of the support column and the upper plate form an acute angle on the overhanging side, such that in an erect state, the support column is inclined, with respect to a direction of gravity, to an opposite side to the overhanging side.

2. The pull-up/chin-up instrument according to claim 1, further comprising:

a position adjustment means for adjusting a fixing position of the pull-up/chin-up handle onto the support column and a length adjustment means for adjusting a length of the support column.

3. The pull-up/chin-up instrument according to claim 1 further comprising:

a lower elastic member that is in contact with the floor surface and attached onto a lower surface of the lower plate; and an upper elastic member that is in contact with the ceiling surface and attached onto an upper surface of the upper plate.

* * * * *